US008124001B1

(12) United States Patent
Wen et al.

(10) Patent No.: US 8,124,001 B1
(45) Date of Patent: Feb. 28, 2012

(54) SYNTHETIC VASCULAR TISSUE AND METHOD OF FORMING SAME

(75) Inventors: Xuejun Wen, Mt. Pleasant, SC (US); Vince Z. Beachley, Mt. Pleasant, SC (US); Vladimir A. Mironov, Mt. Pleasant, SC (US); Vladimir A. Kasyanov, Riga (LV)

(73) Assignee: Clemson University Research Foundation, Clemson, SC (US)

( * ) Notice: Subject to any disclaimer, the term of this patent is extended or adjusted under 35 U.S.C. 154(b) by 196 days.

(21) Appl. No.: 12/468,979

(22) Filed: May 20, 2009

Related U.S. Application Data

(60) Provisional application No. 61/054,832, filed on May 21, 2008, provisional application No. 61/054,850, filed on May 21, 2008.

(51) Int. Cl.
*D06M 10/00* (2006.01)
*H05B 7/00* (2006.01)

(52) U.S. Cl. ..... 264/465

(58) Field of Classification Search ..... 264/465
See application file for complete search history.

(56) References Cited

U.S. PATENT DOCUMENTS

| | | | |
|---|---|---|---|
| 1,975,504 | A | 10/1934 | Formhals |
| 2,187,306 | A | 1/1940 | Formhals |
| 6,355,699 | B1 | 3/2002 | Vyakarnam et al. |
| 6,743,273 | B2 | 6/2004 | Chung et al. |
| 6,753,454 | B1 | 6/2004 | Smith et al. |
| 6,821,479 | B1 | 11/2004 | Smith et al. |
| 7,575,707 | B2 | 8/2009 | Xia et al. |
| 2004/0237494 | A1 * | 12/2004 | Karayianni et al. ..... 57/212 |
| 2005/0104606 | A1 | 5/2005 | Donsky |
| 2005/0137675 | A1 * | 6/2005 | Dubson et al. ..... 264/465 X |
| 2005/0224998 | A1 | 10/2005 | Andrady |

FOREIGN PATENT DOCUMENTS

WO WO 2010/096795 8/2010

OTHER PUBLICATIONS

Dalton, et al., "Electrospinning with dual collection rings", *Polymer*, 46, (2005), pp. 611-614.
Katta, et al., "Continuous Electrospinning of Aligned Polymer Nanofibers onto a Wire Drum Collector", *Nanoletters*, (2004), vol. 4, No. 11, pp. 2215-2218.
Teo, et al., "Electrospun fiber bundle made of aligned nanofibres over two fixed points", *Nanotechnology*, 16, (2005), pp. 1878-1884.
Abstract of Article—*Electrospinning of Polymeric and Ceramic Nanofibers as Uniaxially Aligned Arrays*, Li et al., Nano Letters, 3 (8), 2003, pp. 1167-1171.
Related U.S. Appl. No. 12/054,668, filed Mar. 25, 2008.

* cited by examiner

*Primary Examiner* — Leo B Tentoni
(74) *Attorney, Agent, or Firm* — Dority & Manning, P.A.

(57) ABSTRACT

Disclosed are composite materials that can more closely mimic the mechanical characteristics of natural elastic tissue, such as vascular tissue. Disclosed materials include a combination of elastic nanofibers and non-elastic nanofibers. Also disclosed are a variety of methods for forming the composite materials. Formation methods generally include the utilization of electrospinning methods to form a fibrous composite construct including fibers of different mechanical characteristics.

12 Claims, 11 Drawing Sheets

PRIOR ART

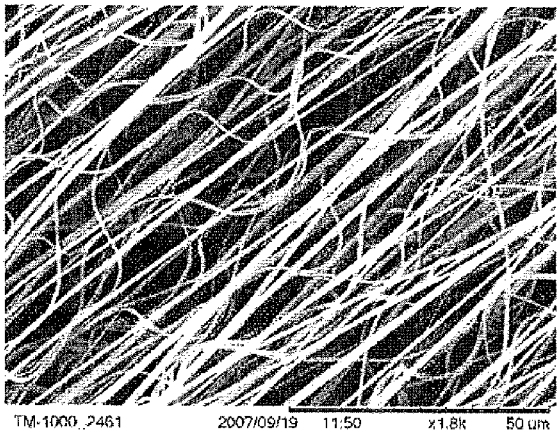
FIG. 10
FIG. 11
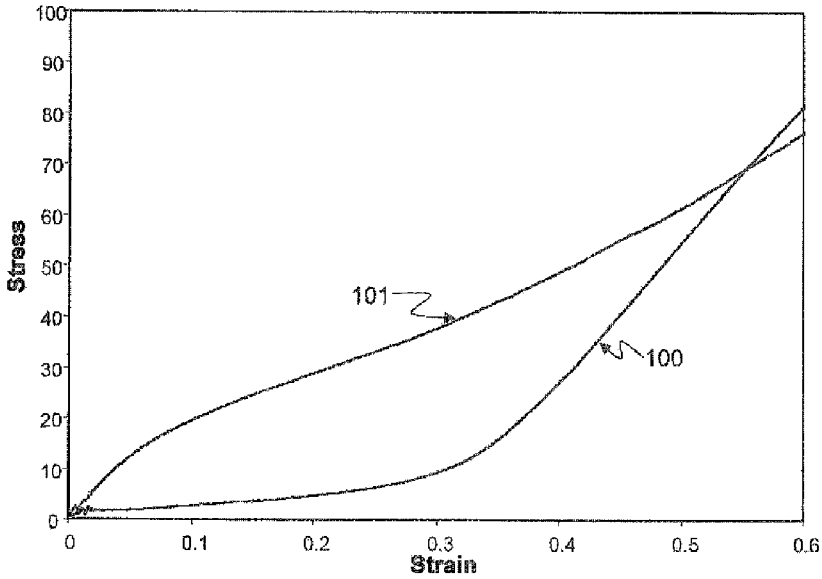

SYNTHETIC VASCULAR TISSUE AND METHOD OF FORMING SAME

CROSS REFERENCE TO RELATED APPLICATION

This application claims filing benefit of U.S. Provisional Applications having Ser. Nos. 61/054,832 and 61/054,850, both filed May 21, 2008, both of which are incorporated herein by reference.

BACKGROUND

The most common cause of cardiovascular disease is atherosclerosis, a chronic inflammatory response in the walls of arteries due to accumulation of an atheromatous plaque at the vessel wall that leads to hardening of an artery and loss of blood flow. Often, the diseased vessels will require surgical repair, either through implantation of a stent or replacement or bypass with a synthetic or natural vascular graft.

Both of these options are problematic, however. For instance, the six month restenosis rate for a vessel following implantation of a stent is about 20% for large diameter vessels and almost 33% for small diameter vessels. When considering replacement or bypass, even when utilizing a saphenous vein autograft, the ten year patency of the graft is about 50%, and synthetic prostheses have even lower patency rates. Moreover, suitable saphenous veins are often unavailable for utilization and morbidity rates increase with this approach.

One of the primary problems with available vascular graft materials is the mismatch between mechanical properties of the native and the implanted materials. Native vessels are elastic in nature and expand under pressure during blood flow. A mismatch between the elastic characteristics of a native vessel and an implant segment can disturb the blood flow pattern due to both velocity and pressure changes as well as geometric inconsistencies. For instance, FIGS. 1A-1C schematically illustrate flow inconsistencies that can occur due to this mismatch between a native vessel and an implanted vessel segment. FIG. 1A illustrates a native vessel 10 with a regular blood flow pattern indicated by the directional arrows. In FIG. 1B, vessel 10 includes an implanted vessel segment 12 that describes greater expansion under pressure than that of the native vessel 10. As can be seen, the implanted vessel segment 12 can expand beyond the diameter of the native vessel, leading to a more turbulent flow pattern through the segment. Likewise, with reference to FIG. 1C, the addition of a vessel segment 14 that describes less expansion under pressure than a native vessel 10, can also lead to development of a more turbulent flow pattern through the vessel. Disturbed blood flow patterns due to mechanical property mismatch between native and implanted vascular tissue has been implicated in low patency rates for grafts.

What are needed in the art are synthetic materials that can be formed to more closely mimic the mechanical characteristics of native tissues to which they can be grafted.

SUMMARY

According to one embodiment, disclosed herein is a biocompatible fibrous composite comprising a first electrospun elastic nanofiber and a second electrospun nanofiber that exhibits little or no elasticity. More specifically, a composite web can be formed such that the second, nonelastic nanofiber defines a sinuous path along the axial length when the first, elastic nanofiber is in a relaxed state. Accordingly, as the elastic nanofiber is stretched and becomes lengthened, the second, non-elastic nanofiber will alter in morphology to describe a straighter conformation.

According to one preferred embodiment, the fibrous composite is implantable. For instance, disclosed materials can be utilized in one embodiment as a vascular graft in which the web defines an axial length and a lumen along the axial length of the web.

Also disclosed are methods of forming the composite materials. A method can include, for example, electrospinning a first nanofiber onto a collection area, the first nanofiber comprising a biocompatible elastic polymer. The method also can include extending the first nanofiber from a first length to a second length and electrospinning a second nanofiber onto the collection area while the first nanofiber is held at the second length, the second nanofiber comprising a biocompatible polymer exhibiting little or no elasticity. Upon relaxation of the elastic nanofiber from the second length back to the first length, the second nanofiber will take on a sinuous conformation along the axial length.

The collection area can be, in one embodiment, an air gap defined between a first conductive plate and a second conductive plate. According to this embodiment, the formed fibers can be generally aligned with one another.

According to another embodiment, the collection area can be an air gap defined between mobile collection surfaces, the method further comprising moving the first nanofiber away from the collection area via the mobile collection surfaces prior to electrospinning the second nanofiber onto the collection area.

According to yet another embodiment, the collection area can be a rotating mandrel.

BRIEF DESCRIPTION OF THE DRAWINGS

A full and enabling disclosure, including the best mode thereof, to one of ordinary skill in the art, is set forth more particularly in the remainder of the specification, including reference to the accompanying figures, in which:

FIG. 10 is a scanning electron micrograph (SEM) image of one embodiment of a composite material as described herein;

FIG. 11 graphically illustrates mechanical properties of composite materials as described herein;

FIGS. 15A-15F illustrate a composite fiber mat as describe herein stretched to increasing levels of strain, and FIGS. 15G-151 illustrate the composite fiber mat upon relaxation;

Figure 1A:
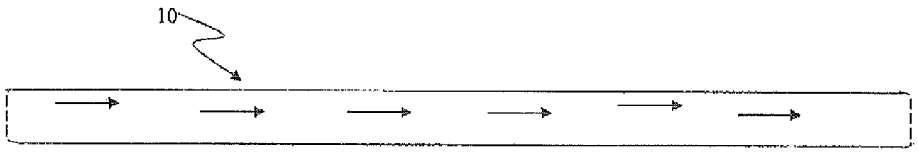
FIGS. 1A-1C are schematic diagrams illustrating problems associated with previously known implantable tissue graft materials.
Figure 1B:
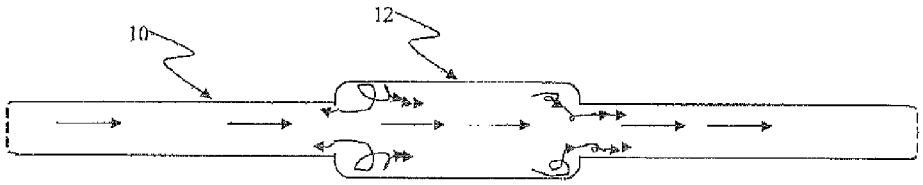
Figure 1C:
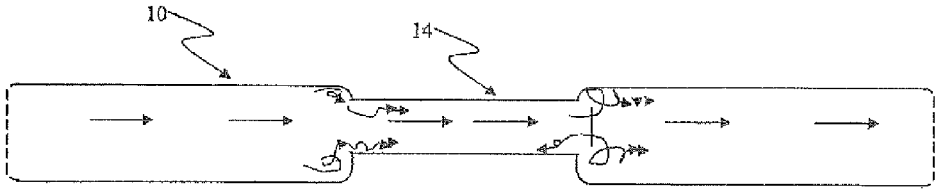

Repeat use of reference characters in the present specification and drawings is intended to represent the same or analogous features or elements of the present invention.

DETAILED DESCRIPTION

Reference will now be made in detail to various embodiments of the disclosed subject matter, one or more examples of which are set forth below. Each embodiment is provided by way of explanation, not limitation, of the subject matter. In fact, it will be apparent to those skilled in the art that various modifications and variations may be made in the present disclosure without departing from the scope or spirit of the disclosure. For instance, features illustrated or described as part of one embodiment, may be used in another embodiment to yield a still further embodiment. Thus, it is intended that the present subject matter cover such modifications and variations as come within the scope of the appended claims and their equivalents.

The present disclosure is generally directed to composite fibrous materials that can more closely mimic the mechanical characteristics of natural vascular tissue. The disclosure is also directed to a variety of methods for forming the disclosed materials, primarily through the utilization of electrospinning methods to form a fibrous composite construct that can closely mimic the mechanical characteristics of, e.g., natural vascular tissue.

Natural vascular tissue includes a large amount of connective tissue, the primary extra cellular matrix (ECM) proteins of which are elastin and collagen. Collagen and elastin together are primarily responsible for the strength, elasticity and integrity of vascular tissue. Chemically, collagen is a triple helix formed of three extended protein chains that wrap around one another. In vivo, many rod-like collagen molecules are cross-linked together in the extracellular space to form collagen fibrils that have the tensile strength of steel, but little elasticity. Elastin is a protein that is somewhat similar to collagen in chemical make-up, but differs greatly in mechanical characteristics and is the principal structural component of elastic fibers. Elastin polypeptide chains are cross-linked together to form rubber-like, elastic fibers. Unlike collagen, elastin molecules can extend into a longer conformation when the fiber is stretched and will recoil spontaneously as soon as the applied force is relaxed.

Figure 2:
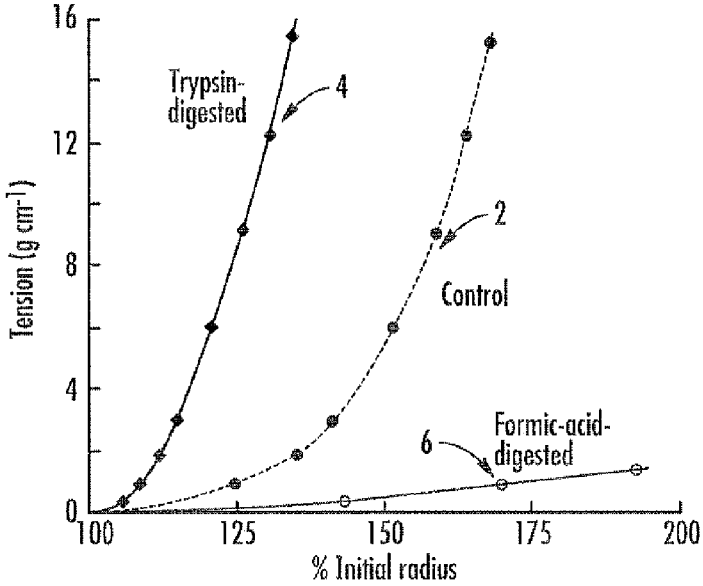
FIG. 2 graphically illustrates the mechanical properties of natural blood vessels as well as the contribution of the primary structural proteins of blood vessels to the mechanical properties of the vessel.

FIG. 2 graphically illustrates the stress/strain curve of natural vascular tissue (2, control). The graph also shows the contribution of each protein, elastin and collagen, to the overall stress/strain curve of a natural tissue. Specifically, curve 4 exhibits the stress/strain profile of a tissue following trypsin digestion and illustrates the contribution of collagen to the overall stress/strain profile of the tissue. Curve 6 exhibits the stress/strain profile of a tissue following formic acid digestion and illustrates the contribution of elastin to the overall stress/strain profile of the tissue. As can be seen, each protein dominates different regions of the overall stress/strain profile of a tissue and each is required to obtain the normal mechanical characteristics of the tissue.

According to the present disclosure, composite materials are disclosed including both highly elastic fibers and fibers exhibiting little or no elasticity. Disclosed composite materials can closely mimic the histological structure and can closely match the compliance of natural vascular tissue. More specifically, disclosed composite materials are nonwoven webs that can include a plurality of fibers defining a cross-section on a nanometer scale (i.e., fiber diameter of less than about 1 micrometer) in a predetermined orientation. In one preferred embodiment, nanofibers of the composite materials can be generally aligned with one another, i.e., the orientation lines defined by adjacent nanofibers can be within about ±20° of parallel of one another. Nanofibers of disclosed materials can include elastic nanofibers in combination with substantially non-elastic nanofibers. For purposes of the present disclosure, the term 'substantially non-elastic' is utilized interchangeably with the term 'non-elastic' and generally refers to a material exhibiting a stiffness of at least from about 10 to about 100 times that of the elastic material utilized in the composite.

Disclosed materials can be formed such that when a composite structure is not under a load in the axial direction of the elastic fibers, i.e., not under a load that can extend the elastic fibers, the non-elastic fibers are compressed in a nonlinear orientation, i.e., a wavy or crimped orientation. In other words, the non-elastic fibers can define a sinuous path along their axial length when the elastic fibers are relaxed. The different fiber types can be provided in the disclosed composite materials so as to provide a synthetic material that can closely mimic characteristics of any targeted elastic tissue. For instance, the chemistries of components utilized in a composite, the relative amounts of elastic and non-elastic components utilized, the orientation of components throughout a composite, and so forth, can be adjusted so as to provide a formed composite material with desired mechanical characteristics specific to a targeted natural tissue including, without limitation, tensile strength, elastic modulus, anisotropic qualities, and so forth.

Figure 3:
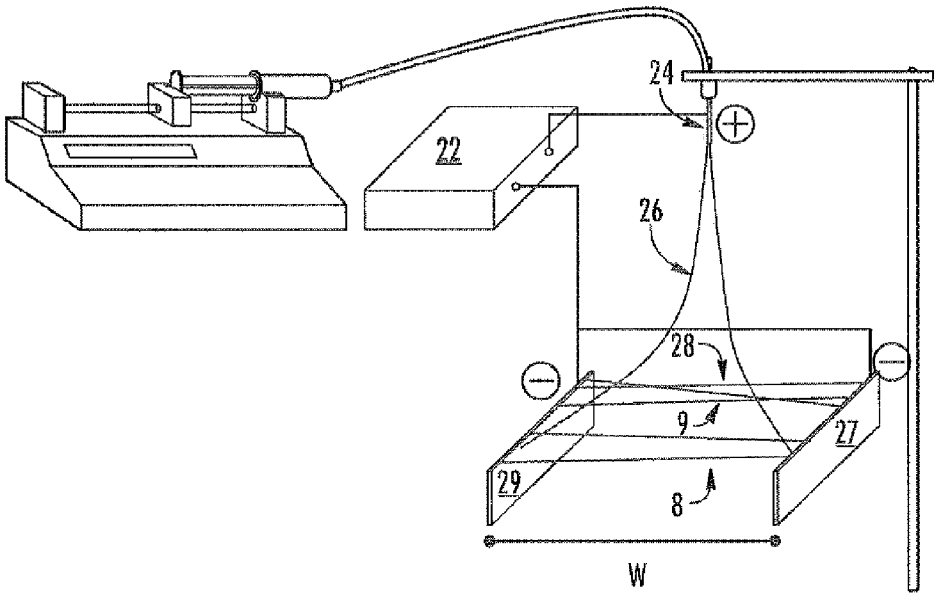
FIG. 3 illustrates one system for forming a composite material as may be utilized in forming a composite web as described herein.

In general, nanofibers of disclosed materials can be formed according to an electrospinning process, one embodiment of which is illustrated in FIG. 3. An electrospinning process includes the use of a high voltage power supplier 22 to apply an electrical field to a polymer melt or solution held in a capillary tube 24, inducing a charge on the individual polymer molecules. Upon application of the electric field, a charge and/or dipolar orientation will be induced at the air-surface interface. The induction causes a force that opposes the surface tension. At critical field strength, electrostatic forces will overcome surface tension forces, and a jet 26 of polymer material will be ejected from the capillary tube 24 toward a conductive, grounded collection area 28. The jet 26 is elongated and accelerated by the external electric field as it leaves the capillary tube 24. As the jet 26 travels in air, some of the solvent can evaporate, leaving behind charged polymer fibers which can be collected at the collection area 28. As the fibers 8, 9 are collected, the individual and still wet fibers may adhere to one another prior to solvent evaporation, forming a nonwoven web.

In the embodiment illustrated in FIG. 3, the collection area 28 includes parallel conductive plates 27, 29 on either side of the collection area 28. The plates 27, 29 produce an electric field that can align the deposited fibers across the air gap of the collection area 28. This method has been used to collect two dimensional arrays of aligned and oriented fibers (see, e.g., Li, et al., Nanoletters, 2003, 3:8, 1167, which is incorporated herein by reference).

According to disclosed methods, a solution including a first elastic polymer can be electrospun to form a plurality of elastic fibers at a collection area 28. The first polymer can be any elastic biocompatible polymer including homopolymers, block copolymers, random copolymers, polymeric blends, and so forth. In one preferred embodiment, the first polymer can be an implantable polymer For instance, elastic polymers for use as described herein can include, without limitation, any biocompatible polyurethane, organosilicone, butyl rubber, ethylene propylene diene terpolymer (EPDM), polysulfide rubber, silicone rubber, neoprene (polychloroprene), chlorosulfonated polyethylene, acrylonitrile-butadiene copolymer (nitrile rubber), styrene butadiene copolymer, acrylonitrile butadiene, copolymer-polyvinyl chloride polymer blends, polyisobutylene, polyepichlorohydrin, natural and synthetic polyisoprene, polyvinyl chloride-polybutadiene rubber, polyurethanes, fluorocarbon elastomers such as vinylidene, fluoride-chlorobifluorethylene copolymers, vinylidene-fluoride-hexafluorethylene copolymers, and fluoroacrylate elastomers, and the like.

An ejectable composition including the polymer can be loaded into the electrospinning capillary tube 24. For example, a sol-gel, a solution, or a melt may be loaded into the capillary tube 24. A polymeric solution loaded into an electrospinning capillary tube 24 can include any suitable solvent. By way of example, acetic acid, acetonitrile, m-cresole, tetrahydrofuran (THF), toluene, dichloromethane ($CH_2Cl_2$), methanol (MeOH), dimethylformamide, as well as mixtures of solvents are typical of solvents as may be utilized in disclosed processes. Selection of preferred solvent for any particular fiber formation process can be determined according to standard methods and as such is not discussed at length herein.

As is generally known in the art, the critical field strength required to overcome the forces due to surface tension of the solution and form a jet 26 will depend on many variables of the system. These variables include not only the type of polymer and solvent, but also the solution concentration and viscosity, as well as the temperature of the system. In general, characterization of the jet formed, and hence characterization of the fibers formed, depends primarily upon solution viscosity, net charge density carried by the electrospinning jet and surface tension of the solution. The ability to form the small diameter fibers depends upon the combination of all of the various parameters involved. For example, electrospinning of lower viscosity solutions will tend to form beaded fibers, rather than smooth fibers. In fact, many low viscosity solutions of low molecular weight polymers will break up into droplets or beads, rather than form fibers, when attempts are made to electrostatically spin the solution. Solutions having higher values of surface tension also tend to form beaded fibers or merely beads of polymer material, rather than smooth fibers. Thus, the preferred solvent for any particular embodiment will generally depend upon the other materials as well as the formation parameters, as is known in the art.

Referring again to FIG. 3, a polymeric composition including an elastic polymer, e.g., a solution or melt, can be loaded into an electrospinning capillary tube or nozzle 24. According to standard electrospinning methodology, upon application of a suitable voltage (generally on the order of about 5 to about 30 kV), the repulsive electrostatic forces induced at the liquid/air interface will overcome the surface tension forces, and a jet 26 of liquid will be ejected, as shown. The jet 26 is first stretched into a Taylor cone structure. As the jet 26 travels toward the grounded deposition area 28, some of the solvent can evaporate, leaving behind charged polymer fibers 8, 9. As can be seen, the deposition area 28 can be between two spaced apart conductive plates 27, 29. Accordingly, the charged polymer fibers 8, 9 can be generally aligned in the deposition area 28, between the conductive plates 27, 29, as illustrated, with either end of the fibers 8, 9 adhering to the respective conductive plates 27, 29, as shown. Materials as may be utilized in forming the conductive plates 27, 29 can be any conductive material as is generally known in the art. For example, conductive plates 27, 29 can be the same or different as one another and can include, without limitation, aluminum, copper, a laminate structure including a surface layer of a conductive material, or the like.

Conductive plates 27, 29 can generally be separated from one another by a distance W of between about 2 mm up to about 10 cm, or even greater in other embodiments, for instance up to about 20 cm or even greater. In one embodiment, fibers of a length of up to about 50 cm can be formed. Maximum possible width, W, is generally understood to be related to fiber diameter, as well as other formation parameters.

Following formation of a mat of elastic fibers in the deposition area 28, a composition including a second, non-elastic polymer can be electrospun on top of the elastic fibers while the elastic fibers are in an extended orientation.

Figure 4A:
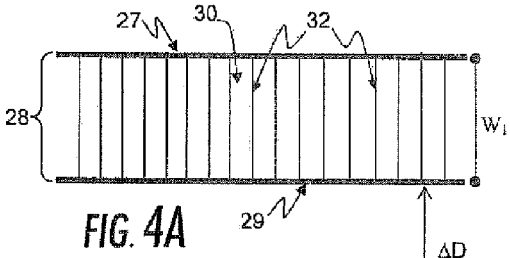
FIGS. 4A-4D schematically illustrate steps of formation of a composite material as described herein formed across a collection rack.
Figure 4B:
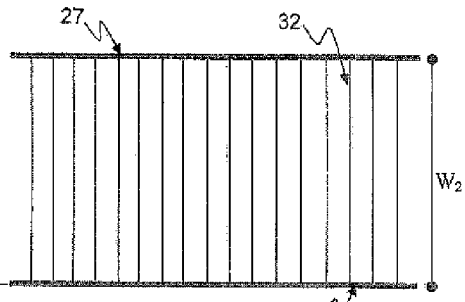

With reference to FIG. 4A, a mat 30 including a plurality of aligned elastic fibers 32 can be formed in the deposition area 28 defined between plates 27, 29 at a distance $W_1$ from one another. Following formation, the distance $W_1$ between plates 27, 29 can be increased to $W_2$ by a distance $\Delta D$, and the elastic fibers 32 can be stretched to a longer orientation, as shown at FIG. 4B. Following stretching of elastic fibers 32, non-elastic polymer fibers 34 can be electrospun over the top of or intermixed with the first polymer fibers 32 and can have a length of $W_2$.

Non-elastic polymers for use in disclosed methods and materials can include any non-elastic polymers that have been found suitable for use in biological applications including homopolymers, block copolymers, random copolymers, polymeric blends, and so forth. In one preferred embodiments, suitable non-elastic polymers can be implantable. For instance, non-elastic polymers for use as described herein can include, without limitation, alginates, polylactides, polyacrylates (e.g., polymethylmethacrylate), poly(hexano-6-lactone) (commonly referred to as $\epsilon$-caprolactone or PCL), and so forth. In one embodiment, non-elastic biodegradable polymers available from the Lactel Corporation including polycaprolactone (PCL), polylactide (PLA), including L-PLA and DL-PLA, and poly(DL-lactide-co-glycolide) can be used.

Similar to formation of elastic nanofibers, a composition that can be electrospun to form non-elastic fibers can include a sol-gel, solution, or melt and can include any suitable solvent as is known or can be determined according to methods as are known to one of skill in the art.

Upon formation of non-elastic fibers 34, the two fibers types can become entangled with one another or can merely lie alongside one another. Depending upon formation methods, additives, etc., the different fiber types 32, 34 of a composite mat can include more or less adhesion between fibers and fiber types. For instance, in one embodiment, prior to and/or during solvent evaporation, fibers of a composite web can become adhered to one another at random spots along the fiber lengths. According to another embodiment, a composite material can have little physical adherence between fibers such as is formed during solvent evaporation. For example, in one embodiment the elastic fibers 32 can be completely dried prinr to formation of the non-elastic fibers 34, and little physical adhesion can occur between fiber types upon formation of the non-elastic fibers. According to this embodiment, adherence between fiber types can be due primarily to either electrostatic binding between fibers or fiber entanglement, with little physical adhesion between fiber types due to evaporation of solvent or setting of melt during fiber formation.

Figure 4C:
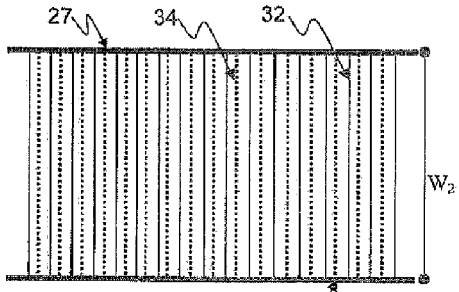
Figure 4D:
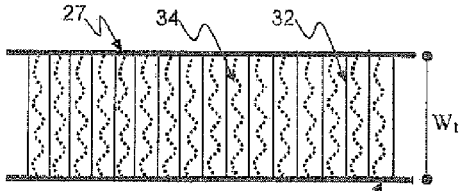

Following formation of a plurality of non-elastic fibers 34 in conjunction with the extended elastic fibers 32, a composite web can lie in the deposition area 28, as illustrated in FIG. 4C. Upon release of the tension on the elastic fibers, through either relocation of plates 27, 29 back to original width $W_1$, as shown, or through release of the fibers 32, 34 from the plates 27, 29, the elastic fibers 32 can return to their initial length and the non-elastic fibers 34 can be compressed and obtain a wavy, sinuous morphology, as shown at FIG. 4D.

Figure 5:
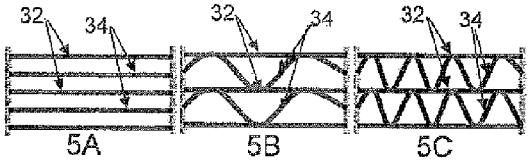
FIGS. 5A-5C schematically illustrate exemplary embodiments of disclosed composites, each of which describe different extension capabilities.

As previously mentioned, the specific characteristics of any composite material can be predetermined by choice of materials as well as formation methods. For instance, the overall extension capability of a composite can be effected by the distance ΔD that an elastic fiber is extended prior to formation of a non-elastic fiber on the mat. With reference to FIG. 5A, elastic fibers 32 and non-elastic fibers 34 are shown when both fiber types are fully extended. Accordingly, in this embodiment, additional substantive extension of the web would not be possible. At FIG. 5B, a mat is shown in which the non-elastic fibers 34 exhibit only a small amount of sinuous morphology along their axial length. The ultimate extension capability of the composite material of FIG. 5B will be only that distance that will fully extend the non-elastic fibers 34. At FIG. 5C is shown a composite material in which the non-elastic fibers 34 exhibit a more sinuous path, with more curvature along the length of the fibers 34. As such, the composite shown at FIG. 5C will exhibit a greater extension capability than will the composite shown at FIG. 5B.

Additional layers can be formed in a composite material, as desired, for instance through repetition of the above-described layer formation processes. For instance, a composite material of a greater depth can be formed including both elastic fibers and non-elastic fibers throughout the depth of the material. In the non-extended state, the material will include the compressed non-elastic fibers with a crimped, wavy type of morphology.

Formation methods are not limited to utilization of an electrospinning process including static conductive plates as illustrated in FIG. 3. In particular, any formation method can be utilized as can provide the desired mixture of elastic and non-elastic nanofibers as described herein.

Figure 6:
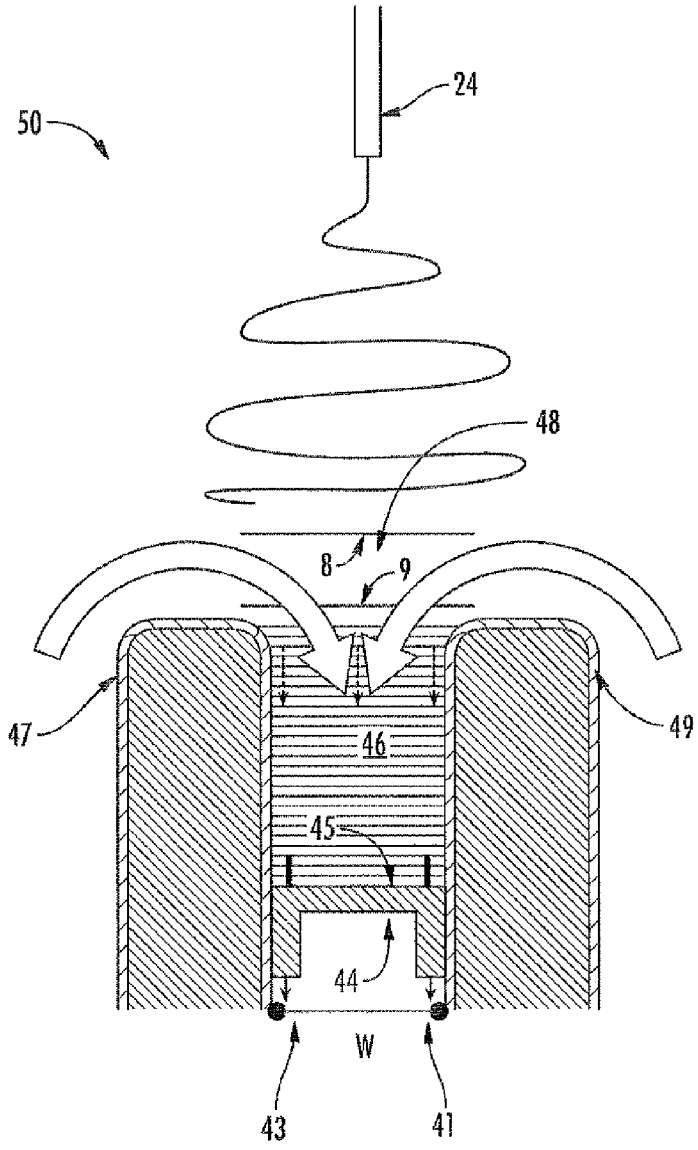
FIG. 6 illustrates another system for forming a composite material as may be utilized in forming a composite web as described herein.

For example, and with reference to FIG. 6, in another embodiment, a formation process can utilize a system 50 including a collection area 48 located between two mobile conductive collection surfaces 47, 49.

The relationship between the conductive collection surfaces 47, 49 and the applied voltage at the electrospinning nozzle 24 produces an electric field, similar to that of the static system illustrated in FIG. 3, that aligns the nascent fibers 8, 9 and causes deposition of the fibers in generally parallel alignment across the gap between the two collection surfaces 47,49 in the deposition area 48.

In contrast to the system 20 of FIG. 3, system 50 includes the capability of mobility such that following deposition in the deposition area 48, the nascent fibers can be moved away from the deposition area 48. For instance, in the embodiment illustrated in FIG. 6, the collection surfaces 47, 49 of system 50 can be endless tracks formed of a conductive material that move as illustrated by the directional arrows in FIG. 6 and move the newly formed fibers away from the deposition area 48 and into collection compartment 46.

During formation, an individual fiber 8 can be deposited in the air gap 48 between the collection surfaces 47, 49, as shown. Collection surfaces 47, 49 can rotate down through the collection compartment 46, and the newly formed fiber 8, which is adhered to the collection surfaces 47, 49 at either end of the fiber 8, can move down into the collection compartment 46 with the moving collection surfaces 47, 49.

Beneficially, an individual fiber 8 can move away from deposition area 48 and down into collection compartment 46 prior to deposition of a second fiber 9 immediately above fiber 8. Thus, there can be space between the two fibers 8, 9. As such, a fiber can set or dry, e.g., remaining solvent on a fiber 8, 9 can dissipate and the fibers can dry while separated from one another such that the individual fibers that form a finished composite material need not be tightly adhered to one another. In addition, due to the motion of formed fibers away from a collection area 48, charge build-up at collection area 48 can be prevented. Accordingly, a system such as that illustrated in FIG. 6, in which nascent fibers can be moved away from a collection area, can be utilized to form thicker and/or more dense composite materials.

The speed of the collection surfaces 47, 49 can control the vertical distance between nascent fibers. For instance, surfaces 47, 49 can move at a speed of between about 1 cm/min and about 100 cm/min, for instance about 40 cm/min. Slower and faster speeds for the collections surfaces 47, 49 are possible in other embodiments. For instance, in another embodiment, collection surfaces 47, 49 can move at a speed of between about 0.5 cm/min and about 100 cm/min, or at speeds greater than 100 cm/min in other embodiments. A system 50 can define a minimum formation speed of collection surfaces 47, 49. At or below the minimum formation speed new fibers will be repelled from deposition area 48 due to charge repulsion from the previously formed fibers. The minimum formation speed for any particular embodiment can depend upon the nature of the formed fibers, the width W between collection surfaces 47, 49, the induced charge, and the like.

In one embodiment, a system 50 can include a ground plate 44, at the base of collection compartment 46 as shown in FIG. 6. Ground plate 44 can help prevent build up of repulsive charge between formed fibers, and as such can prevent fiber breakage and encourage formation of thicker mats.

Following formation of a plurality of elastic fibers, and while the formed elastic fibers are held within the collection compartment 46, the distance W can be increased by an amount, such that the formed elastic fibers are extended. While the formed elastic fibers are held in this extended orientation, second non-elastic fibers can be formed and moved into collection compartment 46 upon formation, as described above with regard to the elastic fibers.

Multiple layers of elastic and non-elastic fibers can be formed to any desired depth through utilization of a system 50. Beneficially, as nascent fibers are moved from the deposition area 48 following formation, a composite material can be formed to any desired depth and, in one particular embodiment, a depth greater than can be achieved when utilizing a system such as that illustrated in FIG. 3 that includes static collection plates.

At the base of collection compartment 46, fibers can be detached from collection surfaces 47, 49. For instance, as shown in FIG. 6, the system can include stationary support blocks 43, 41. As the collecting surfaces 47, 49 continue to move down through the collection compartment 46, they can carry the electrospun fibers along with them to the base of the collection compartment 46 where they can pass support blocks 43, 41. As the collection surfaces 47, 49 move past support blocks, 43, 41, individual fibers can be cut from the collection surfaces 47, 49 due to shear forces at the support block/collection surface interface. Of course, a component of a system for removing a fiber from a collection surface need not be in the illustrated form of a stationary support block. Any suitable component can be included to remove the fibers such as, without limitation, a blade, a wedge, a plate, or any other shaped device that can be utilized to shear or cut a fiber from a collection surface.

Following detachment from the collection surfaces 47, 49, the now dry, aligned fibers can collect in a nonwoven loose web or mat 45 at the base of collection compartment 46. Mat 45 can be formed to any desired depth and can include both elastic and non-elastic nanofibers, with very lithe adhesion between individual fibers, e.g., only electrostatic and/or adhesion due to fiber entanglement, and a relatively large amount of open space and porosity within the mat 45. For instance, an as formed composite mat 45 can define a porosity of up to about 650 $mm^2$. For instance, average pore size can be greater than about 0.5 $mm^2$, for example between about 0.5 $mm^2$ and about 600 $mm^2$, between about 1.5 $mm^2$ and about 125 $mm^2$, between about 4.0 $mm^2$ and about 70 $mm^2$, or between about $mm^2$ and about 50 $mm^2$. Individual pore sizes can be smaller. For instance, average pore diameter can be on the micrometer scale, for instance greater than about 10 μm, in one embodiment, or between about 10 μm and about 200 μm, between about 50 μm and about 100 μm, in another embodiment.

Figure 7:
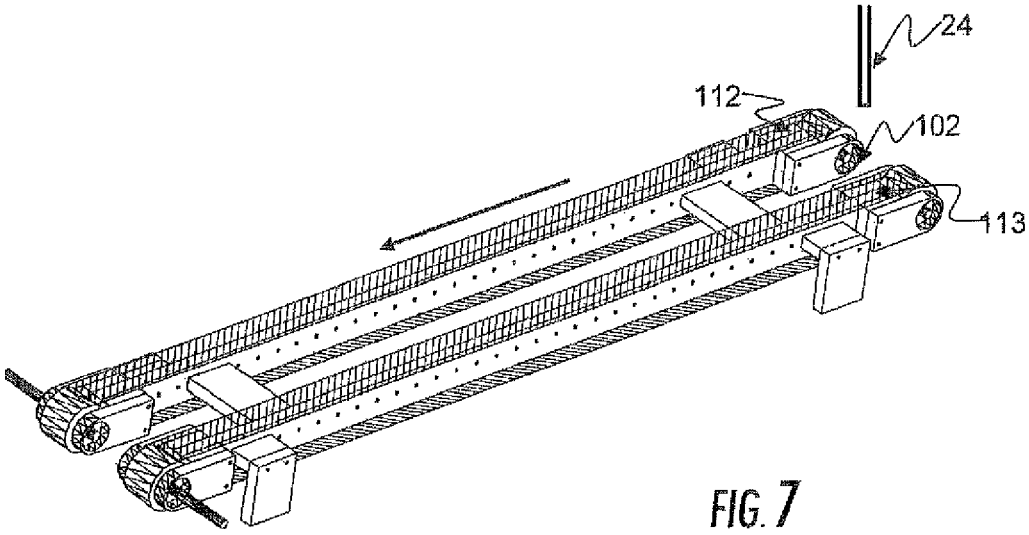
FIG. 7 illustrates another system for forming a composite material as may be utilized in forming a composite web as described herein.

The motion of a deposited fiber away from a deposition area can be in any direction, and is not limited the z-direction as defined by the electrospinning nozzle and as illustrated in FIG. 6. For instance, in another embodiment, illustrated in FIG. 7, following deposition at a deposition area 102 between collection surfaces 112, 113, a formed fiber can move away from the deposition area 102 while remaining in the same plane of formation, as shown by the directional arrow in FIG. 7, i.e., in a direction normal to that direction defined by electrospinning nozzle. Following formation of a desired amount of elastic fibers in the direction illustrated by the directional arrow, the distance between the collection surfaces 112, 113 can be increased, as discussed above, and a plurality of non-elastic fibers can be formed at the increased width. The process can then be repeated to form additional layers of a composite material.

Though illustrated in the Figures as utilizing a single electrospinning nozzle, it should be understood that the disclosed processes are not limited to this particular embodiment. Use of a single nozzle in an embodiment such as that illustrated in FIGS. 3 and 6 can generally form a web of between about 5 and about 20 cm in length, due to the scattering of the jet. Multiple nozzles can be utilized, however, to form longer webs. Alternatively, a system such as that illustrated in FIG. 7 can be utilized to form a longer web.

Motion of fibers away from a collection area is not limited to motion in a single plane. In other embodiment, formed fibers can be moved in multiple directions throughout a process. For example, formed fibers can be moved away from the collection area in a direction normal to the nozzle as well as in the z-direction away from the nozzle. In addition, the deposition area can be altered during the process. For instance, a deposition area can be rotated during formation of a material so as to vary the relative alignment of the fibers throughout the depth and/or length of the web. For example, a first layer of elastic fibers and a second layer of non-elastic fibers can be formed including the fibers in a generally aligned axial direction. Following formation of the first two layers, the deposition area can be rotated and additional layers of fibers can be formed on the first two layers, the fibers of the latter layers having a different axial orientation than the first layers.

In another embodiment, a system can include multiple mobile tracks, so as to move individual fibers in multiple directions. For instance, a first set of tracks can move a nascent web in a direction normal to the ejection jet, while a second set could move the web in a vertical direction.

Figure 8:
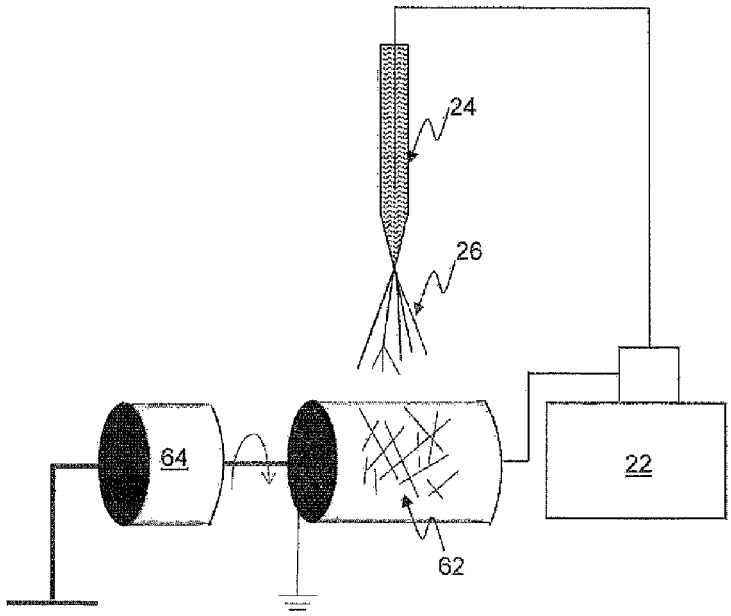
FIG. 8 illustrates another system for forming a composite material as may be utilized in forming a composite web as described herein.

Formation processes in which the collection area is an air gap between separated conducting surfaces in not a requirement of disclosed processes. In another embodiment, illustrated in FIG. 8, a rotating mandrel 62, for instance powered by motor 64, can be utilized to collect nascent fibers 26. For example, non-elastic fibers can be formed on a mandrel 62 including a stretched polymeric film on the surface of the mandrel 62. Upon release of tension of the film, e.g., removal of the film from the mandrel 62, the non-elastic fibers formed thereon can become compressed and take on the wavy, crimple morphology of non-elastic fibers discussed above.

Figure 9:
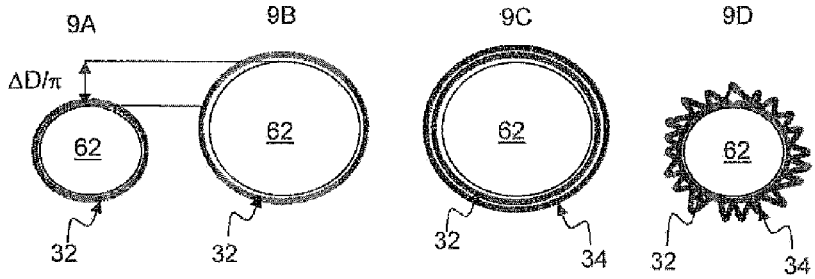
FIGS. 9A-9D schematically illustrate steps of formation of a composite web as described herein formed on a mandrel.

In yet another embodiment, illustrated in FIG. 9, the mandrel 62 can be expandable. According to this embodiment, a layer of elastic fibers 32 can be formed while the mandrel 62 is held at a first diameter (FIG. 9A). Following formation of this layer, the diameter of the mandrel 62 can be increased by an amount of $\Delta D/\pi$, as shown (FIG. 9B), and the elastic fibers formed thereon can be stretched. Subsequently, a layer of non-elastic fibers 34 can be formed over the elastic layer (FIG. 9C). Upon relaxation of the elastic fiber back to their original length, the non-elastic fibers formed thereon can take on a sinuous, wavy morphology (FIG. 9D). If desired, the process can be repeated to form additional layers.

In contrast to the aligned fiber formation processes discussed above utilizing a planar collection area, a formation process utilizing a rotating mandrel as a collection surface can provide one or more layers of a composite material that can describe more isotropic mechanical characteristics, as the fibers can, in one embodiment, be more random in orientation and less aligned than fibers of alternative formation processes described previously. Though, as is known in the art, such a formation process would not necessarily form non-aligned fibers and could also form a web including substantially aligned fibers.

Composite materials as described herein can include additional materials as well, in addition to the elastic and non-elastic fibers described above. For instance, mixtures of materials can be electrospun in disclosed processes so as to form composite nanofibers, as is known in the art. For example, a solution including either elastic or non-elastic polymers in combination with additives can be electrospun to form composite fibers. Additives can generally be selected based upon the desired application and/or characteristics of the formed array. For example, one or more polymers can be electrospun with a biologically active additive that can be polymeric or non-polymeric, as desired. By way of example, a composite material can include an electrospun polymer in conjunction with one or more biologically active materials such as drugs, growth factors, nutrients, cells, proteins and the like. The secondary material can be incorporated in the fibers during formation as is known in the art, for example as described in U.S. Pat. Nos. 6,821,479 to Smith, et al., 6,753,454 to Smith, et al., and 6,743,273 to Chung, et al., all of which are incorporated herein by reference. In another embodiment, secondary materials can be incorporated within the composite web following formation, for instance in the pores defined between individual nanofibers of the composite material.

Additives as may be incorporated in a composite material in conjunction with electrospun polymer fibers can be provided for any desired purpose. For instance, additives can provide desired physical characteristics to formed fibers such as tenacity, modulus, color, and so forth. In one embodiment, additives can be incorporated to provide a more direct benefit to a user. For instance, an additive can be a biologically active agent that can be released into a surrounding area upon implantation of a composite material. For example, a drug, a cofactor, a nutrient, or the like can be incorporated into an elastic and/or a non-elastic fiber during formation and the additive can be released for delivery to a targeted site, for instance an in vivo delivery site following implantation of a synthetic vascular tissue including the fiber. Delivery of a substance can be encourage through leaching of the material along a concentration gradient or optionally through degradation of the fiber, for instance in those embodiments in which one or more fiber types of the composite include biodegradable polymers.

Following initial formation of the composite material, an as-formed material can be processed to a desired shape and size. For instance, following formation and removal from collection surfaces, a flat mat including both elastic and non-elastic fibers can be sized as desired and applied as an implant or a topical graft, e.g., sutured to existing vascular tissue, applied to skin, or to any other tissue to which a graft describing elastic characteristics could prove beneficial. Other processing can additionally be carried out as needed. For instance, a flat section of a composite material as described herein can be shaped and connected to itself or other materials by use of sutures or a bioadhesive to form a synthetic graft have a more complicated, even three dimensional geometry. In one embodiment, a flat section of a composite material can be rolled and the ends thereof can be adhered together using, e.g., sutures, bioadhesives, or the like, to form a seam along the length of the roll and define a lumen within the formed tubular shape. In another embodiment, such as that described above in which a nonwoven web is formed on a mandrel, the circular construction need not define a seam along a length, as the fibers will encircle the structure and form the lumen within the structure during the formation process. Such a form could be used as an implantable vascular graft, for example.

In one embodiment, a secondary material can be included with a composite web. For example, a secondary material can form a covering surface on the composite elastic web, for instance in the lumen or on the outer surface of a synthetic blood vessel graft. For instance, a secondary material such as an elastic polymeric film, e.g., a polyurethane film can be included as an outer wrap on a synthetic blood vessel. Other secondary materials can include support rings, stents, and other known biocompatible and optionally implantable materials.

Secondary materials as may be incorporated in a composite web can also encompass biologically active agents. For instance, a biologically active agent can be incorporated in one or more polymeric solutions that form fibers of the composite web as described above and thus exist within the fibers themselves. A biologically active agent can also be added to a composite web following formation thereof, for instance within a separate layer formed in conjunction with a formed composite web, or through addition of the agent through, e.g., diffusion, following formation of the web. An agent can be released during use of the web, for instance upon degradation of the nanofibers forming the web or upon diffusion of the biologically active agent from within the web following location of the web in a desired environment. For instance, a biologically active agent such as a drug, nutrient, a living cell, an extra cellular matrix component, or some other material as may be beneficially delivered to a target location in a biological system can be incorporated within or on a composite elastic construct as described herein. Accordingly, a composite web as described herein can be utilized as a delivery vehicle for delivering a biologically active agent to a targeted location, and in one particular embodiment, to an in vivo location.

The disclosed subject matter may be better understood with reference to the following examples.

Example 1

Elastic polyurethane (PU, Texoflex® SG-80A) was dissolved in hexafluoro-2-propanol (Oakwood) at 8% w/v and polycaprolactone (PCL, $M_n$=80,000, Sigma) was dissolved in 3:1 dichloromethane/dimethylformamide (Sigma) at 18% w/v. In order to visualize and distinguish fibers from two different materials, the fluorescent carbocyanine dye Dil (Invitrogen) was added to PU solution and green fluorescent DiO dye (Invitrogen) was added to PCL solution at 0.03 mg/ml. The solutions were fed through a 23 gauge needle at 0.015-0.020 ml/min and a voltage of 8 kV was applied to the needle tip to initiate electrospinning of polymer nanofibers. A layer of PU fiber was collected first on a system similar to that illustrated in FIG. 6 and stretched. PCL fibers were then collected on top of the stretched PU layer. The composite fiber mat was relaxed to the original length of the PU fibers, which caused the PCL fibers to configure in a wavy, sinuous configuration similar to the arrangement of collagen fibers in natural blood vessels.

In one formation process, 4 layers of aligned PU fibers and 3 layers of aligned PCL fibers were collected across a rack. PU layers were collected at a length of $L_0$ and stretched to $1.55 \times L_0$. PCL fibers were collected at a length of $1.55 \times L_0$ on top of the stretched PU layer. Upon relaxation of the mat back to $L_0$, the PU fibers pulled the PCL fibers into a wavy configuration. Analysis by scanning electron microscope confirmed that some of the fibers 34 were straight and aligned, while other fibers 32 were in a wavy orientation (FIG. 10). Fluorescent pictures (not shown) further confirmed that polyurethane fibers were straight and the PCL fibers were sinuous in morphology.

The nanofiber mats were mechanically tested for tensile strength and stress strain curves were obtained. FIG. 11 illustrates the stress/strain relationship of a PU/sinuous PCL composite fiber mat 100, formed as described above, and a PU/straight PCL mat 101, formed according to a similar process, except that the PU fibers were not stretched prior to formation of the PCL fibers on the mat for the composite of 101.

Figure 12:
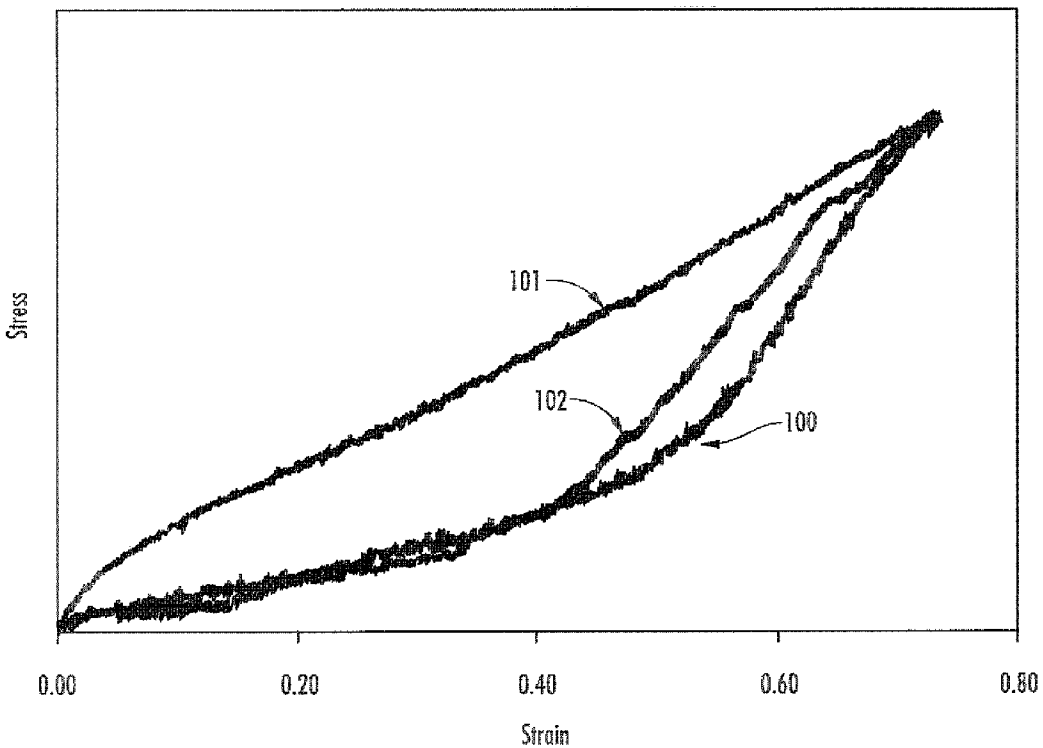
FIG. 12 compares mechanical characteristics of composite materials as described herein with those of native aorta.

In FIG. 12 the shape of the normalized stress strain curves of a PU/sinuous PCL composite fiber mat 100, and a PU/straight PCL mat 101, as previously described, are compared with that for native aorta tissue 102. As can be seen, the composite structure formed as described herein, including the non-elastic fibers in a compressed orientation when the structure is not under an elongation load, closely mimics the stress/strain curve of the native aorta tissue.

Example 2

Figure 13:
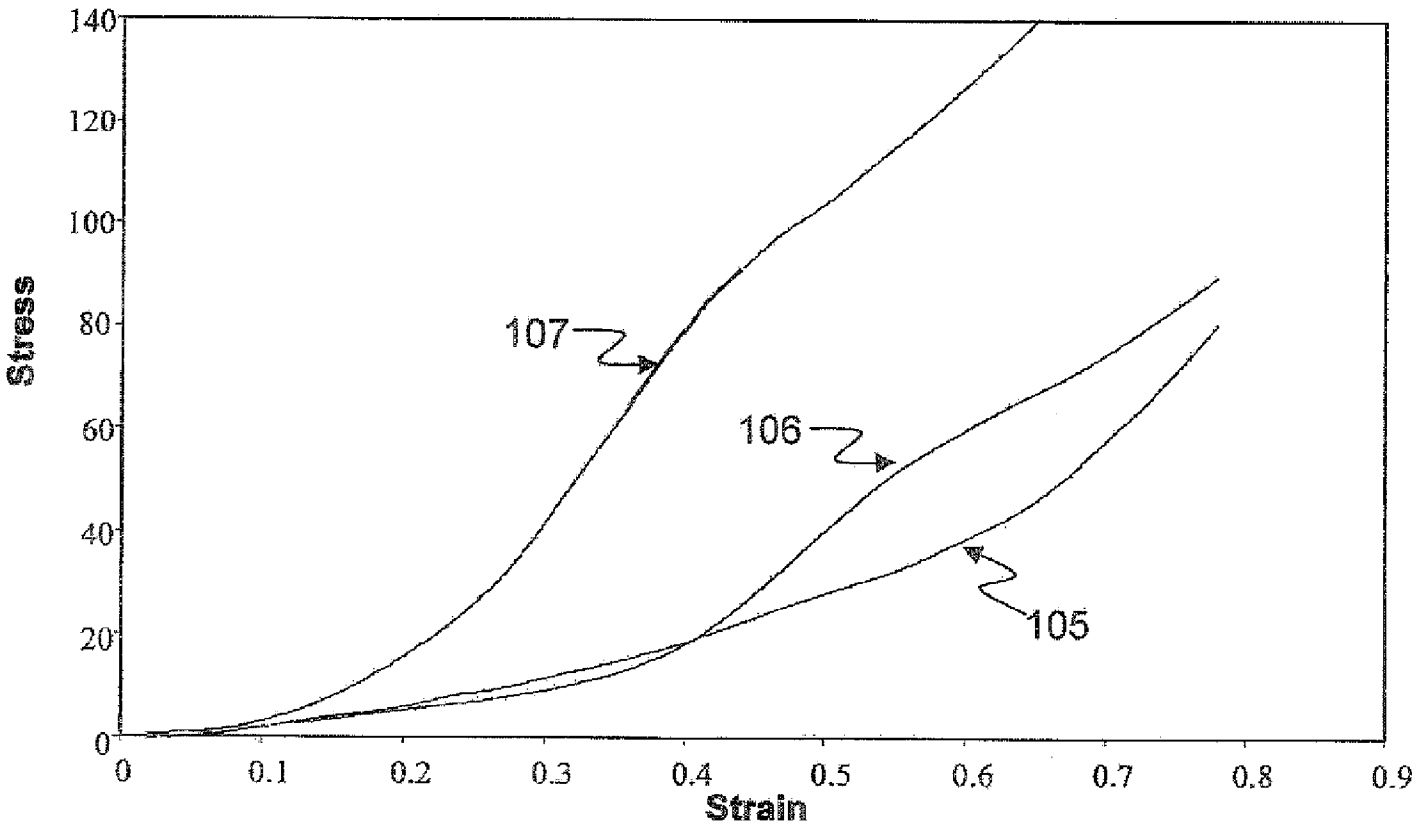
FIG. 13 illustrates the effect of altering the ratio of highly elastic to less elastic polymers on the mechanical characteristics of a composite material as described herein.

To determine the effect of formation parameters on the mechanical characteristics of a composite web formed as described herein, the ratio of elastic fibers to non-elastic fibers was varied during formation of composite materials. Formation materials and methods were as described above in Example 1. Three different composite materials were formed, the first including a ratio of elastic PU fibers to non-elastic PCL fibers of 3:1, the second including a 1:1 ratio of elastic PU fibers to non-elastic PCL fibers, and the third including a 1:3 ratio of elastic PU fibers to non-elastic PCL fibers. Stress/strain profiles were obtained for each material, results of which are illustrated in FIG. 13 in which the 3:1 PU:PCL material is shown as curve 105, the 1:1 PU:PCL material is curve 106, and the 1:3 PU:PCL material is curve 107. As can be seen, the relative amount of the elastic and non-elastic materials included in a composite structure can vary the overall mechanical characteristics of a formed material.

Example 3

Composite materials were formed to have a different amount of compression of the non-elastic fibers when the formed material is not under an expansive load as illustrated in FIGS. 5B and 5C. Materials and formation methods were as described above in Example 1.

A first material was formed including only elastic PU fibers and no non-elastic PCL fibers. A second material included elastic PU fibers in combination with non-elastic PCL fibers, with the PCL fibers formed on the PU fibers under no load, i.e., the PU fibers were not stretched during formation of the non-elastic fibers. A third material was formed in which the PU fibers were formed at a first length, $L_0$, and then stretched to a second length, $L_1$, and the non-elastic PCL fibers formed to length $L_1$ thereon. Specifically, the compression value was determined according to the equation: $(L_1-L_0)/L_1$ or, in the illustrated case, (5.25-4)/5.25=0.24) or 24%. The final material was formed with the non-elastic PCL fibers having a compression value of 36%.

Figure 14:
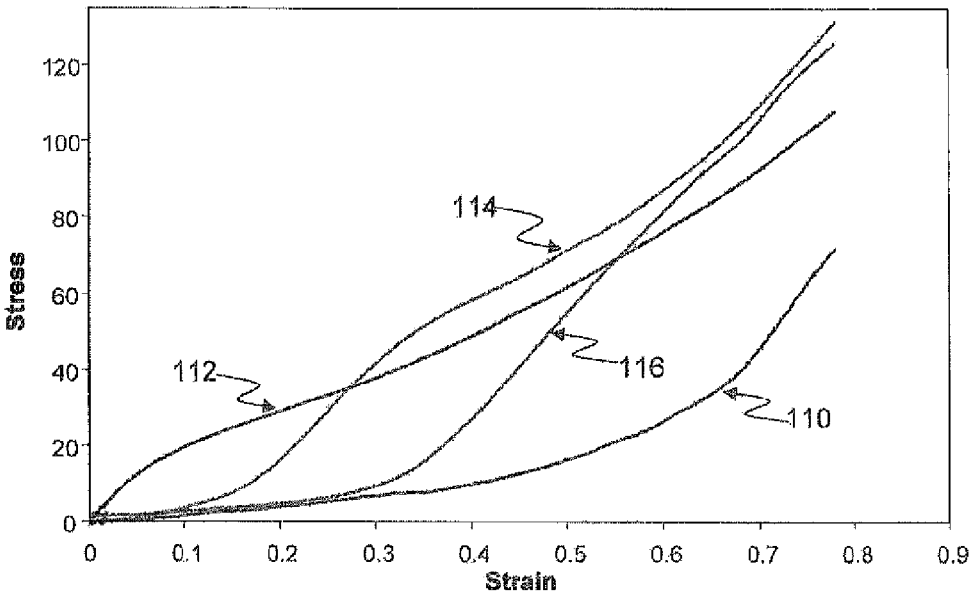
FIG. 14 illustrates the effect of altering the amount of compression of the less elastic polymers of a composite on the mechanical characteristics of a composite material as described herein.

The stress/strain characteristics of the materials were obtained. Results are illustrated in FIG. 14, including the PU material 110, the PU/straight PCL material 112, the PU/26% compression PCL material 114, and the PU/36% compression PCL material 116. As can be seen, the physical characteristics of composite materials as described herein can be specifically engineered to exhibit desired stress/strain characteristics through variation in the amount of stretch of an elastic component during formation of a non-elastic component.

Example 4

Figure 15:
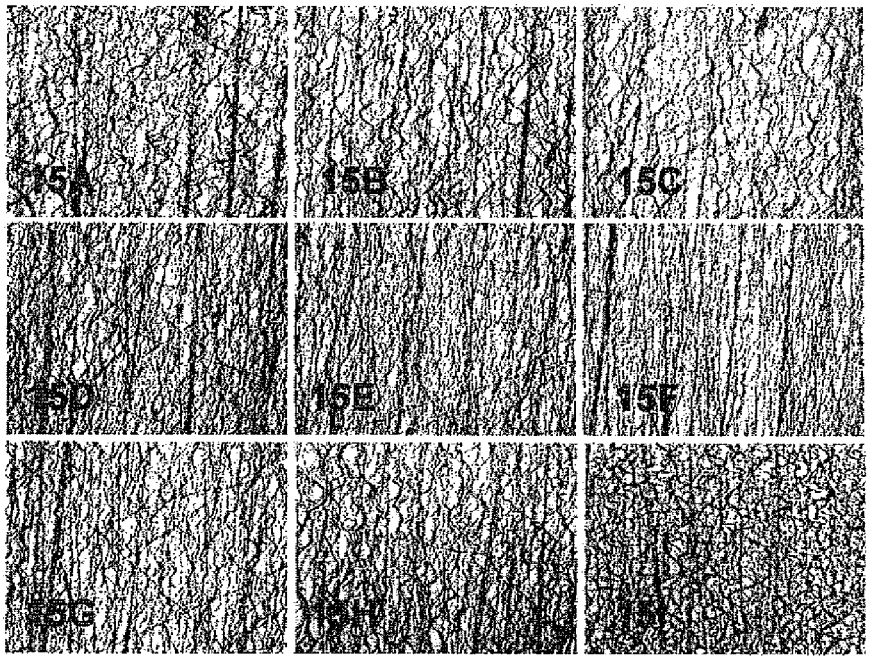
Figure 16:
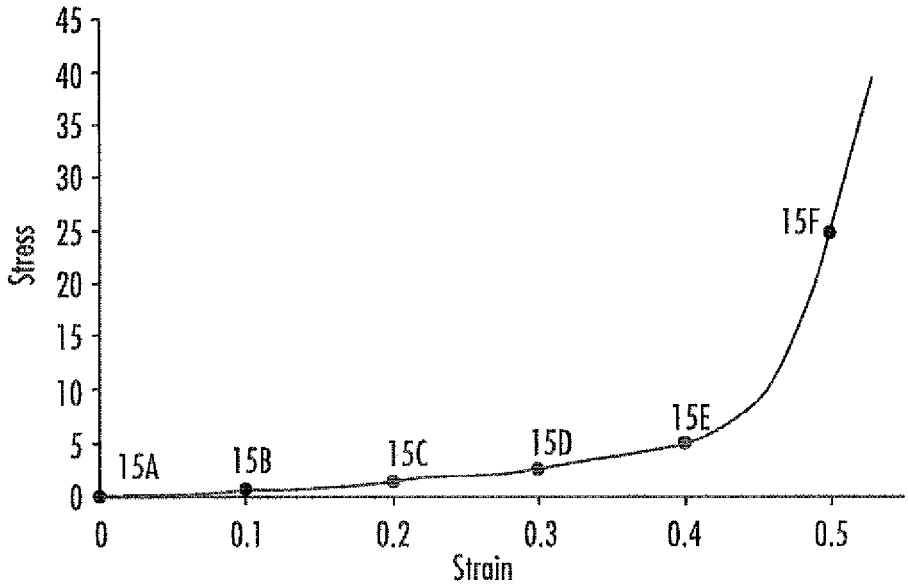
FIG. 16 graphically portrays the data of FIGS. 15A-15F.

A PU/PCL mat was formed as described above in Example 1. Following formation, the mat was stretched with increasing loads. FIGS. 15A-15F illustrate the mat at increasing strain (change in length/initial length) from 0 (FIG. 15A) to 0.1 (FIG. 15B), 0.2 (FIG. 15C), 0.3 (FIG. 15D), 0.4 (FIG. 15E), and 0.5 (FIG. 15F). Following, the mat was released, with photographs being taken at strain of 0.3 (FIG. 15G), 0.1 (FIG. 15H) and 0 (FIG. 15I). The stress vs. strain curve during the extension process is illustrated in FIG. 16.

Figure 17:
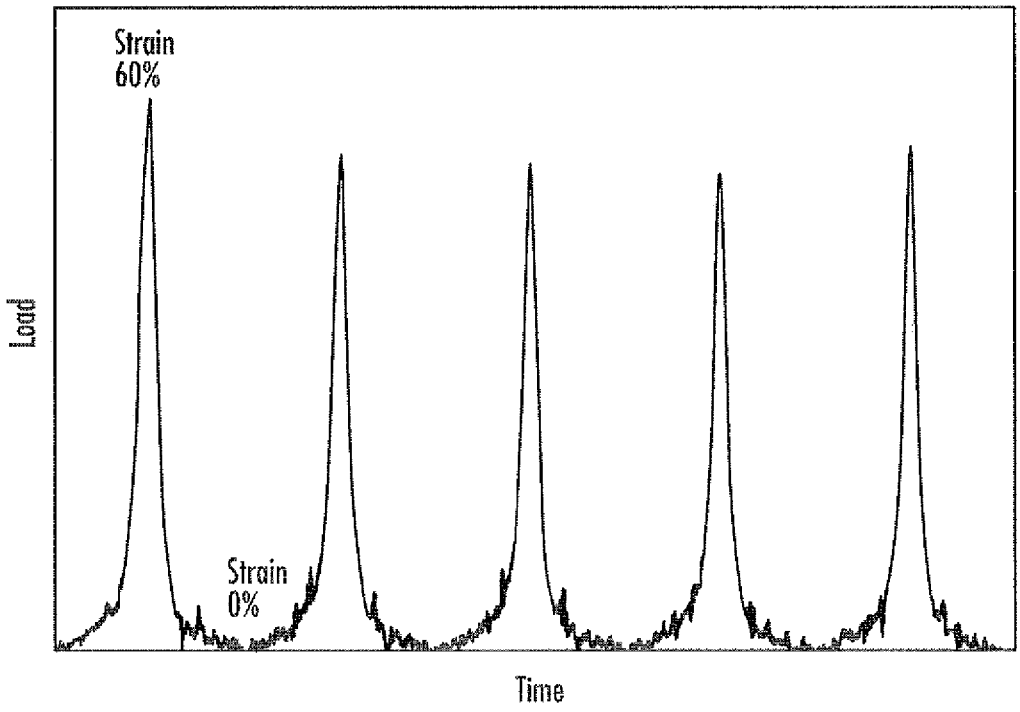
FIG. 17 graphically illustrates load vs. time for a composite fiber mat as described herein loaded from 0 to 60% strain repeatedly at a rate of 0.05 mm/sec.

FIG. 17 illustrates the load vs. time curve for this same mat as it was repeatedly extended from 0 to 60% of maximum strain at a rate of 0.05 mm/second.

It will be appreciated that the foregoing examples, given for purposes of illustration, are not to be construed as limiting the scope of this disclosure. Although only a few exemplary embodiments have been described in detail above, those skilled in the art will readily appreciate that many modifications are possible in the exemplary embodiments without materially departing from the novel teachings and advantages of this disclosure. Accordingly, all such modifications are intended to be included within the scope of this disclosure which is herein defined and all equivalents thereto. Further, it is recognized that many embodiments may be conceived that do not achieve all of the advantages of some embodiments, yet the absence of a particular advantage shall not be construed to necessarily mean that such an embodiment is outside the scope of the present disclosure.

What is claimed is:

1. A method for forming a biocompatible composite nonwoven web comprising:

electrospinning a plurality of first nanofibers onto a collection area, the first nanofibers comprising a biocompatible elastic polymer;

following electrospinning of the plurality of first nanofibers, electrospinning a plurality of second nanofibers onto the collection area over the top of or intermixed with the plurality of first nanofibers while the plurality of first nanofibers is in an extended orientation, the plurality of second nanofibers comprising a biocompatible polymer exhibiting little or no elasticity; and relaxing the plurality of first nanofibers to a non-extended orientation, wherein the plurality of second nanofibers take on a sinuous conformation upon the relaxing of the plurality of first nanofibers.

2. The method according to claim 1, wherein the collection area is an air gap defined between a first conductive plate and a second conductive plate.

3. The method according to claim 1, wherein the plurality of first nanofibers and the plurality of second nanofibers are generally aligned with one another.

4. The method according to claim 1, wherein the collection area is an air gap defined between mobile collection surfaces, the method further comprising moving the plurality of first nanofibers away from the collection area via the mobile collection surfaces prior to electrospinning the plurality of second nanofibers onto the collection area.

5. The method according to claim 1, wherein the method is repeated to form multiple layers on the biocompatible composite nonwoven web.

6. The method according to claim 1, wherein the collection area is a rotating mandrel.

7. The method according to claim 1, the method further comprising extending the plurality of first nanofibers to a first length, wherein the plurality of first nanofibers is in the extended orientation at the first length.

8. The method according to claim 1, the method further comprising rolling the composite nonwoven web to define a tubular shape, the tubular shape defining a lumen.

9. The method according to claim 6, wherein the mandrel is an expandable mandrel.

10. The method according to claim 1, further comprising including a secondary material within or on the surface of the composite nonwoven web.

11. The method according to claim 10, wherein the secondary material is a polymeric film.

12. The method according to claim 10, wherein the secondary material is a biologically active agent.

* * * * *